US008066311B2

(12) United States Patent
Axelrod

(10) Patent No.: US 8,066,311 B2
(45) Date of Patent: Nov. 29, 2011

(54) EASY CLEANING POOPER SCOOPER

(75) Inventor: Glen S. Axelrod, Colts Neck, NJ (US)

(73) Assignee: T.F.H. Publications, Inc., Neptune City, NJ (US)

( * ) Notice: Subject to any disclaimer, the term of this patent is extended or adjusted under 35 U.S.C. 154(b) by 283 days.

(21) Appl. No.: 12/267,424

(22) Filed: Nov. 7, 2008

(65) Prior Publication Data

US 2010/0117387 A1 May 13, 2010

(51) Int. Cl.
*A01K 29/00* (2006.01)
*E01H 1/12* (2006.01)

(52) U.S. Cl. ..... 294/1.4; 294/176

(58) Field of Classification Search ..... 294/1.3, 294/1.4, 1.5, 49, 55; 15/257.1
See application file for complete search history.

(56) References Cited

U.S. PATENT DOCUMENTS

| | | | | | |
|---|---|---|---|---|---|
| D209,660 | S | * | 12/1967 | Lind | D30/162 |
| 3,405,454 | A | | 10/1968 | Zeff | |
| 3,879,079 | A | * | 4/1975 | Nicholas | 294/1.4 |
| 4,383,710 | A | * | 5/1983 | Fehr | 294/1.4 |
| 5,290,080 | A | | 3/1994 | Yoshioka | |
| 5,502,871 | A | * | 4/1996 | Reyes | 15/257.1 |
| 5,562,318 | A | * | 10/1996 | McBroom | 294/1.4 |
| 5,601,321 | A | | 2/1997 | Simon | |
| 6,012,748 | A | * | 1/2000 | Franks | 294/1.4 |
| 6,062,618 | A | | 5/2000 | Figueroa | |
| 6,186,348 | B1 | | 2/2001 | Rouet | |
| 6,202,598 | B1 | | 3/2001 | Willinger | |
| 6,234,549 | B1 | * | 5/2001 | Brownell | 294/1.3 |
| 6,247,735 | B1 | | 6/2001 | Berkman | |
| 6,474,268 | B1 | | 11/2002 | Suchowski | |
| 6,702,349 | B2 | | 3/2004 | Clements | |
| 7,063,044 | B2 | | 6/2006 | Handelsman et al. | |
| 7,343,878 | B2 | | 3/2008 | Ritchey et al. | |
| 2003/0085581 | A1 | * | 5/2003 | Jemison | 294/1.4 |
| 2006/0027555 | A1 | * | 2/2006 | Aisenbrey | 219/385 |
| 2007/0096483 | A1 | * | 5/2007 | Binkowski et al. | 294/1.3 |
| 2007/0212456 | A1 | | 9/2007 | Axelrod | |
| 2008/0048463 | A1 | | 2/2008 | Selenke et al. | |
| 2008/0145631 | A1 | * | 6/2008 | Bhate et al. | 428/220 |

OTHER PUBLICATIONS

International Search Report and Written Opinion dated Dec. 2, 2009 issued in related International Patent Application No. PCT/US09/59668.

Deisher, "What is Teflon Nickel and how can it help me?" available at http://www.techmetals.com/InternetArticles/What%20is%20Teflon%20Nickel%20and%20how%20can%20it%20Help%20Me.pdf; retrieved on Dec. 5, 2008.

PVD, "Low Friction Coating—Graphit-iC coating," available at http://www.pvd-coatings.co.uk/Graphit-iC-coating.htm; retrieved on Oct. 9, 2008.

PVD, "Low Friction coating—MoST coating," available at http://www.pvd-coatings.co.uk/MoST-coating.htm, retrieved on Oct. 9, 2008.

(Continued)

*Primary Examiner* — Dean Kramer
(74) *Attorney, Agent, or Firm* — Grossman, Tucker, Perreault & Pfleger, PLLC

(57) ABSTRACT

A device for retrieving animal feces including a handle portion and a scoop and/or rake portion having a surface. The scoop and/or rake portion contacts the feces for removal, and a portion of the surface of the scoop and/or rake portion includes a coating, wherein the coating exhibits a coefficient of friction (μ) of less than or equal to 1.0 and a contact angle of 90° or greater.

18 Claims, 9 Drawing Sheets

OTHER PUBLICATIONS

PVD, "Low Friction Coating—Dymon-iC DLC Coating," available at http://www.pvd-coatings.co.uk/Dymon-iC-coating.htm, retrieved on Oct. 9, 2008.

ICS Technologies, "Xylan Coatings," available at http://www.icstechnologies.com/brands/xylan.html, retrieved on Oct. 9, 2008.

Gregrobert, "Spade Set Dog Products," available at http://www.pet-dog-cat-supply-store.com/shop/index.php?page=shop-flypage-23638, retrieved on Oct. 8, 2009.

Kurtus, "Coefficient of Friction Values for Clean Surfaces," available at http://www.school-for-champions.com/science/friction_coefficient.htm; retrieved on Oct. 15, 2008.

Net 2 Pets, "Four Paws Rake Sanitary Pooper Scooper," available at http://www.net2pets.com/four-paws-rake-sanitary-pooper-scooper.html; retrieved on Oct. 8, 2008.

Electromold, "Nickel Teflon Nico PTFE," available at http://www.electromold.com.au/index.cfm/products/nickel_teflon_nico_ptfe.html; retrieved on Dec. 8, 2008.

* cited by examiner

FIG. 2
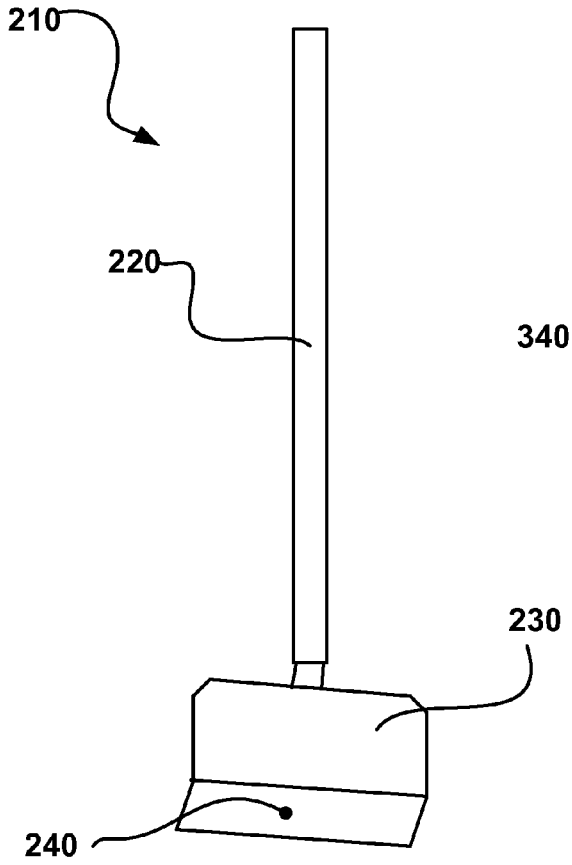
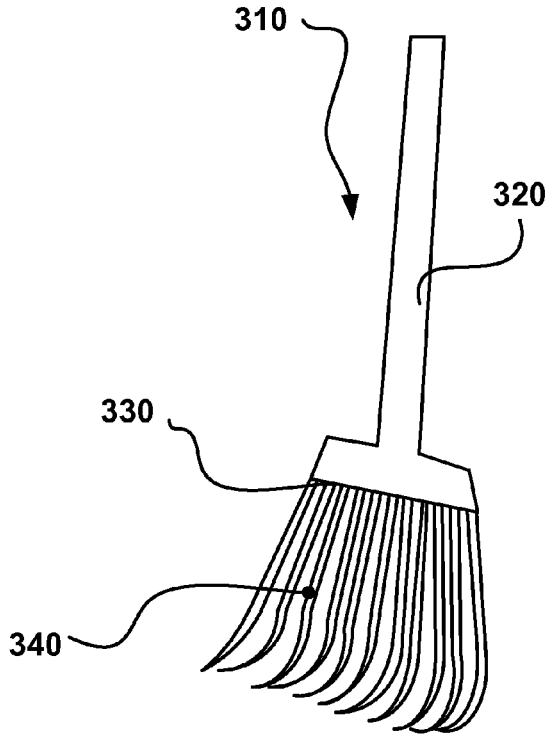
FIG. 3

EASY CLEANING POOPER SCOOPER

FIELD

The present disclosure relates to devices for removing solid animal waste from a surface, often known as "pooper scoopers", and more particularly to providing surfaces on the scoop pusher portions which are relative easy to clean and provides surfaces that do not generally adhere to animal waste.

BACKGROUND

Animal feces, particularly from domesticated dogs and cats may become a nuisance on one's lawn and cleaning up such may be a rather unpleasant task. Modern cities with their sidewalks, streets, and walkways do not provide a natural area for the animals to relieve themselves. This is especially true in cities with large numbers of animals in limited spaces. For this reason, pet owners who are walking their dogs or cats may be required in many cities to remove the feces that their pet produces.

There are a number of devices that have been marketed to make the collection process more sanitary, including shovels, scoops, forceps-like devices that can hold a plastic bag, and various folded cardboard shapes which may be formed into a scoop and even closed to fully contain the feces.

U.S. Pat. No. 5,601,321, assigned to Four Paws Products Ltd., is directed at a device having a pair of cooperating scoops that are pivotally connected and spring-loaded. The scoops may be actuated by squeezing the handle which separates the scoops which may then enclose the feces. Releasing the handle causes the scoops to close. The scoops may have a series of tines or interacting prongs to assist removal of the feces from a grassy surface.

Such devices may have the purpose of preventing any contact directly with the feces and providing a disposable container for the feces. However, in the process of cleaning up such animal waste, such devices as noted above may come in contact with the feces, and if the device is not a disposable type, then the device must be cleaned.

The present disclosure provides an easy to clean, low friction coating on such devices to ease cleaning.

SUMMARY

In a first aspect, the present disclosure is directed at a device for retrieving animal feces. The device may include a handle portion and a scoop and/or rake portion having a surface, wherein the scoop and/or rake portion may contact the feces for removal. At least a portion of the surface of the scoop and/or rake portion may include a coating, wherein the coating exhibits a coefficient of friction (μ) of less than or equal to 1.0 and a contact angle of 90° or greater relative to animal waste.

In a second aspect, the present disclosure is directed at a method of providing a pooper scooper having a surface that is relatively easy to clean. The method may include providing a pooper scooper having a scoop and/or rake portion which may interface with animal feces, the scoop and/or rake portion having a surface and coating the scoop and/or rake portion with a coating, wherein at least a portion of the surface of the scoop and/or rake portion includes a coating, wherein the coating exhibits a coefficient of friction (μ) of less than or equal to 1.0 and a contact angle of 90° or greater relative to animal waste.

In a third aspect, the present disclose is directed at a method of retrieving animal solid waste. The method may include providing a pooper scooper and retrieving the animal solid waste. The pooper scooper may include a scoop and/or rake portion which may interface with animal feces, the scoop and/or rake portion having a surface coated with a coating, wherein at least a portion of the surface of the scoop and/or rake portion includes a coating, wherein the coating exhibits a coefficient of friction (μ) of less than or equal to 1.0 and a contact angle of 90° or greater relative to animal waste; and retrieving the animal solid waste.

BRIEF DESCRIPTION OF THE DRAWINGS

The accompanying drawings, which are incorporated in and constitute a part of the specification, illustrate embodiments of the invention and, together with the description, serve to explain principles of the invention.

FIG. 2 is a perspective view of another example of a device for collecting animal feces;

FIG. 3 is a perspective view of another example of a device for collecting animal feces;

DETAILED DESCRIPTION

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present disclosure provides a coating having a relatively low coefficient of friction that may be applied to the "working" surfaces of pooper scoopers, and such to allow easy cleaning, for instance by rinsing off with water from a hose, such that the device is readily reusable.

Figure 1:
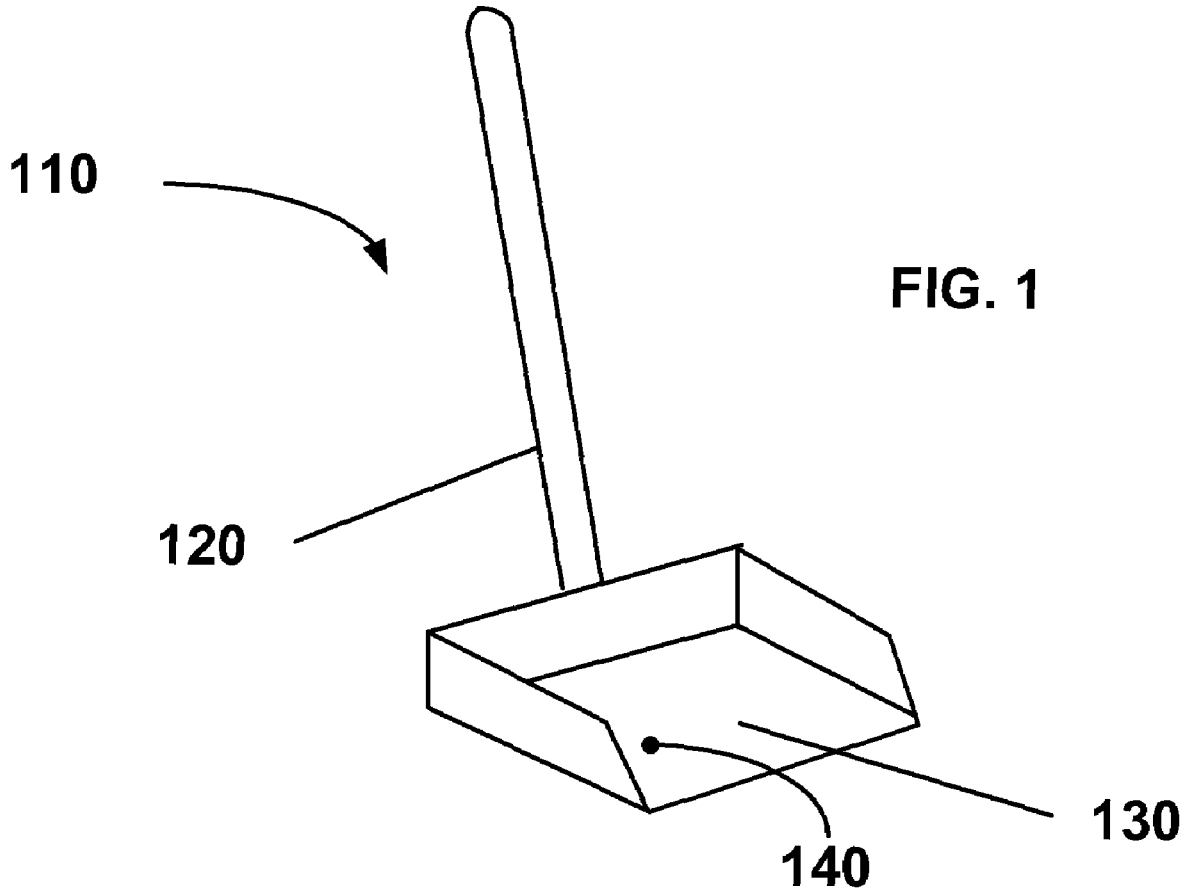
FIG. 1 is a perspective view of an example of a device for collecting animal feces.

FIG. 1 illustrates a device 110 having a handle 120 of wood, plastic or a metal or metal alloy which is attached to a scoop 130. The scoop 130 maybe a lightweight metal, such as aluminum formed to shape, or may comprise a relatively rigid plastic molded scoop, for instance of polystyrene or acrylonitrile-butadiene- styrene (ABS). In operation, the scoop 130 may be slipped under the feces which may be residing on a surface and tipped towards the handle to contain and control the waste. After disposing of the waste, the scoop 130 may be cleaned by washing and wiping so that the surface of the scoop is relatively sanitary. This may be a somewhat cumbersome process and may generate additional waste such as paper towels, rags and cleaning water that then must be disposed of. In the illustrated example, the device in FIG. 1 may include a handle about 3 feet long. However it may be appreciated that the handle may vary in size between a couple of inches and 5 or 6 feet, including all values and increments therein.

In addition, the scoop may be used in conjunction with a shovel or other raking device as illustrated in FIGS. 2 and 3 respectively. For example, a shovel 210, illustrated in FIG. 2, may include a handle portion 220 attached to a scoop 230. Or a raking device 310, illustrated in FIG. 3, may include a handle 320 and rake including a series of prongs or tines 330. These devices may also contact animal feces and may require cleaning as well. A rake portion herein may therefore be understood as any sort of geometry that may be utilized together with a scoop portion to facilitate the handling of animal waste.

To make the cleaning of such scoop devices relatively easier, the scoop and/or rake portion may now be coated with a relatively low friction coating (e.g. a static and/or kinetic coefficient of friction ($\mu$) relative to animal waste of less than or equal to 1.0. More specifically, the coefficient of friction as described may have a value of 0.01-1.0, including all values and increments therein, in 0.01 increments. Animal waste may be understood as relatively solid feces having a moisture content of less than or equal to 50%. Accordingly, the surface may be one that inherently rejects the attachment of feces and thereby provides the consumer with a much easier task of maintaining a clean surface and sanitary conditions.

Of course, the cleaning may be augmented by rinsing with a stream of water from a faucet or hose and/or other appropriate fluid (e.g. a disinfectant solution). In FIG. 1, reference numeral 140 identifies a surface of the scoop portion which may be one of the selected surfaces to be coated with the above referenced low friction coating. Similarly FIGS. 2 and 3 reference a surface of the "scoop" portions 240, 340 respectively, of such devices that may be coated with the above referenced low friction coating. Any surface which may contact animal waste may therefore be selected for the low friction coating and therefore benefit from the presence of the coating including the top, bottom and/or sides of the scoop portion 230, 330.

In one exemplary embodiment, the scoop portion may specifically comprise metal and be coated with a layer of a polymeric material. The material may include fluoropolymers, which may be understood as a repeating unit that contains one or more C—F bonds. For example, the repeating unit may comprise tetrafluoroethylene, which may be identified as —$[CF_2CF_2]$—, and/or ethylene-tetrafluoroethylene —$[CH_2CH_2]$—$[CF_2CF_2]$—. The fluoropolymer may also comprise perfluoroalkoxytetrafluoroethylene or fluorinated ethylene-propylene (FEP). The material may also include a polyacetal, of the formula —$[OCH_2]$—, which may be available under the tradenames DELRIN™ or CELCON™. The coating may also include a polysiloxane polymer or polyethylene, such as ultra-high molecular weight poly(ethylene) (UHMWPE). UHMWPE may be understood as a polyethylene polymer having a number average molecular weight of over 1 million. The coating may also include a polypropylene resin.

In addition other coatings materials, such as metal, metal alloy or ceramic coatings may be utilized as well such as electroless nickel coating, molybdenum disulphide based coatings, metal glass and/or transceramic coatings, etc.

The polymeric coatings may be applied by a number of processes such as over-molding, dip-coating, spray coating, etc. The metal, metal alloy or ceramic coatings may be applied by chemical bath processes, physical vapor deposition processes, chemical vapor deposition process, as well as thermal spray processes. It may be appreciated that the surface to be treated may be pretreated to promote coating adhesion, such as by removing any oxides that may be on a metallic surface or by flame or corona treatment in the case of polymer materials, increasing the surface energy of the material to be treated.

In another exemplary embodiment, a coating of electroless nickel and PTFE may be deposited on the metal scoop portion to provide a surface having a coefficient of friction of less than 0.2 when tested to ASTM D-2714. The coating may be deposited by plating the nickel and PTFE particles simultaneously, or the electroless nickel may be deposited first, followed by an impregnation process to infuse the PTFE particles into the surface of the electroless nickel coating. The PTFE particles may be present at up to about 25% by volume.

Figure 4:
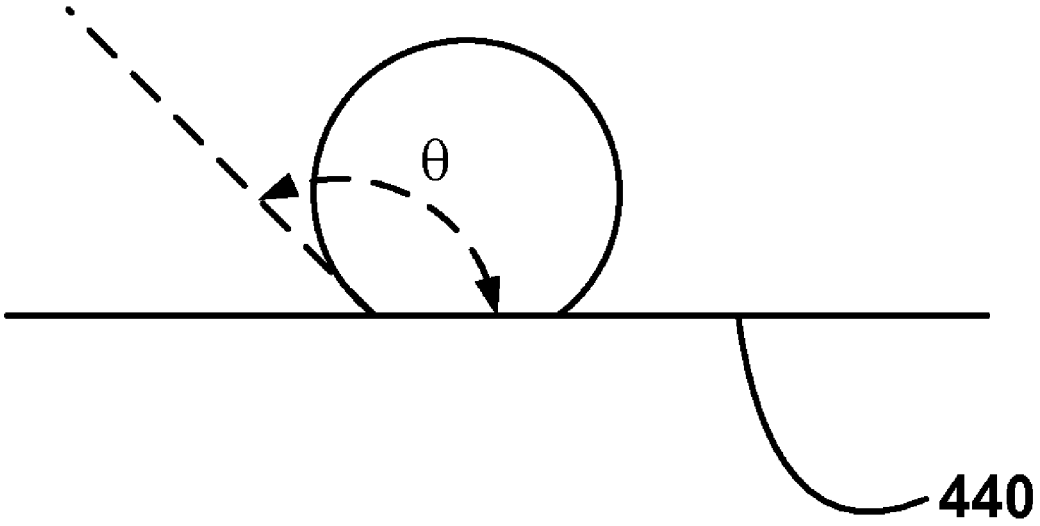
FIG. 4 illustrates an example of a measurement of contact angle.

It may be appreciated that the coatings contemplated herein may change the hydrophobicity of the surface, in addition to providing a relatively low coefficient of friction as between the solid waste to be removed and the coatings. Hydrophobicity may be understood as the degree to which a surface may repel water. Hydrophobicity may be quantified by the contact angle, i.e., the angle at which a liquid or vapor meets a solid surface 440. In one embodiment, illustrated in FIG. 4, the coatings may provide a contact angle $\theta$ of greater than 90 degrees, as measured by the sessile drop method, including all values and increments therein, such as in the range of 90 to 150 degrees, or 100 to 130 degrees, etc.

Figure 5:
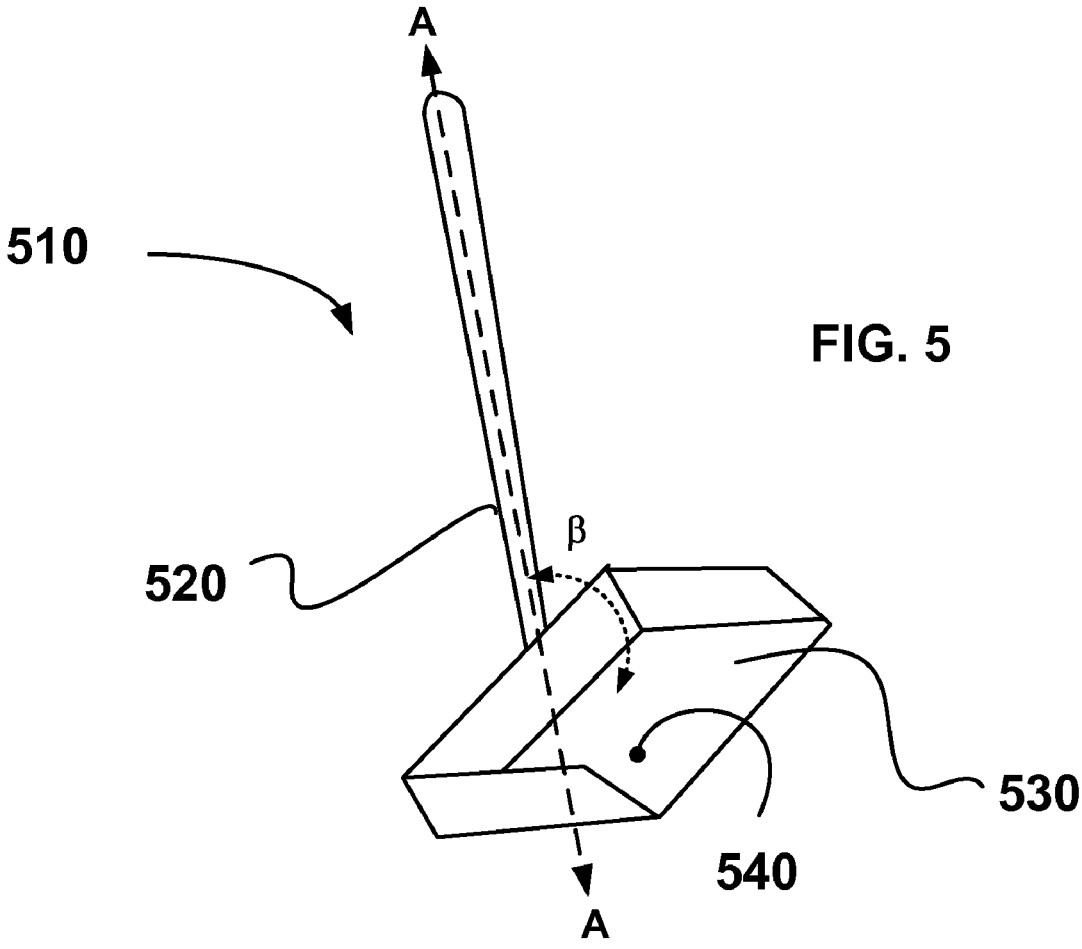
FIG. 5 illustrates a perspective view of another example of a device for collecting animal feces.

The coating discussed above may be applied to the scoop surfaces in a number of waste retrieval devices. For example, FIG. 5 illustrates a device 510 that includes a scoop 530 wherein the angle $\beta$ of the scoop surface 540 is less than 90 degrees from the axis A-A, which may be defined by the handle 520, including all values and increments in the range of 30 to less than 90 degrees. In such a manner, it may be appreciated that when the scoop is lifted from the ground, the waste material may be retained in the scoop without sliding off the face of the scoop, which may otherwise happen due to the addition of the coating. It may also be appreciated that such a scooper may not necessarily require the coating disclosed herein, and may amount to an uncoated surface. In any event, the control of angle $\beta$ as now disclosed may ensure that when the scooper handle 520 is held in a vertical position, the scooper will urge the waste into the bottom of scooper and may be more efficiently transported.

Figure 6:
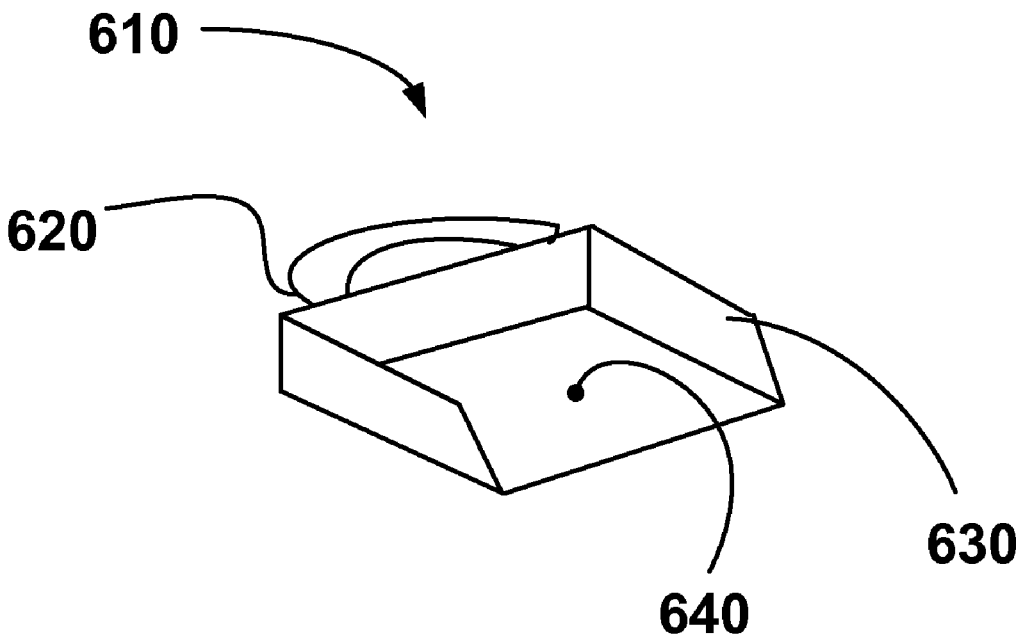
FIG. 6 illustrates a perspective view of another example of a device for collecting animal feces.
Figure 7:
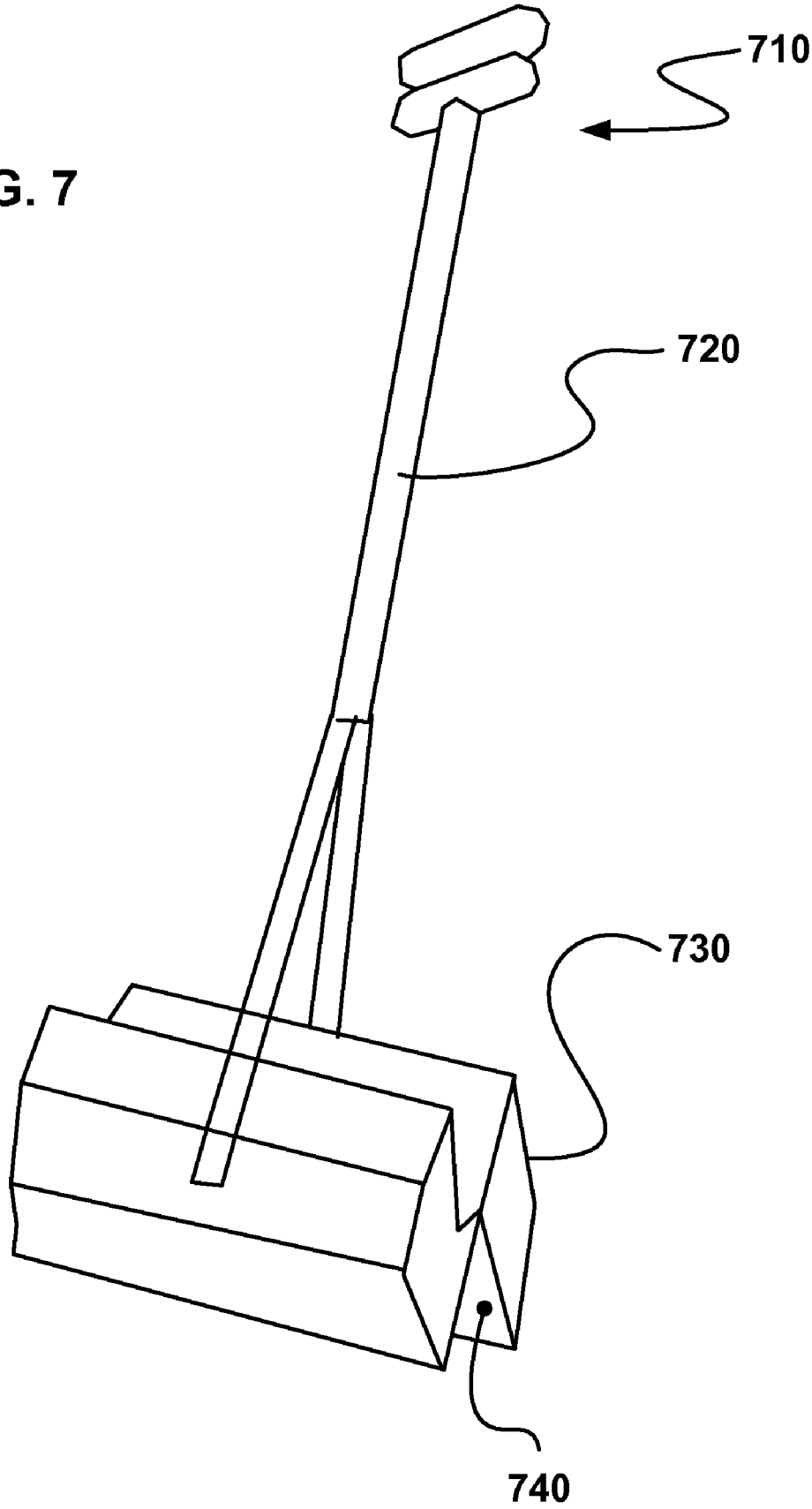
FIG. 7 illustrates a further example of a device for collecting animal feces.
Figure 8:
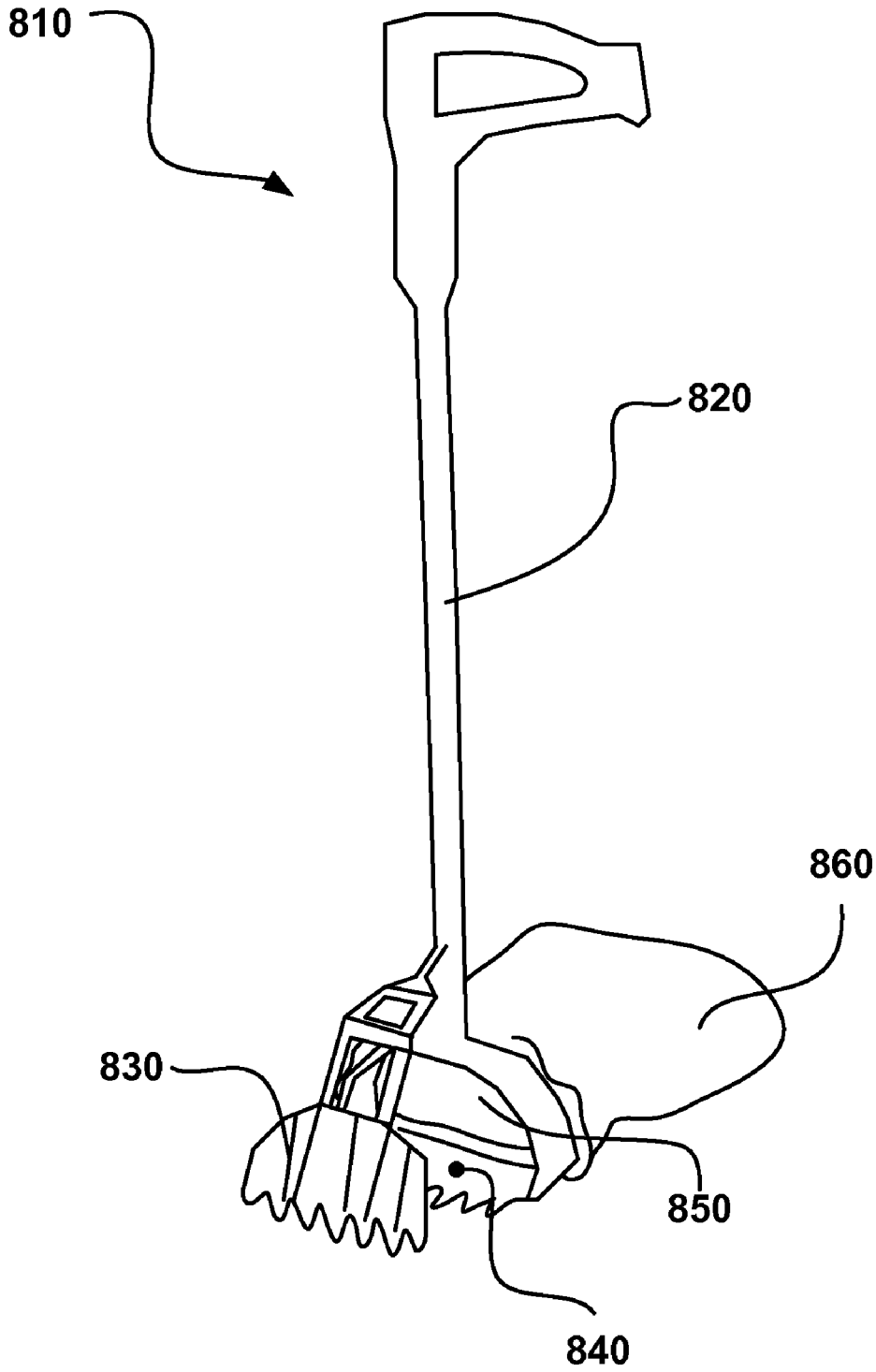
FIG. 8 illustrates yet a further example of a device for collecting animal feces.
Figure 9:
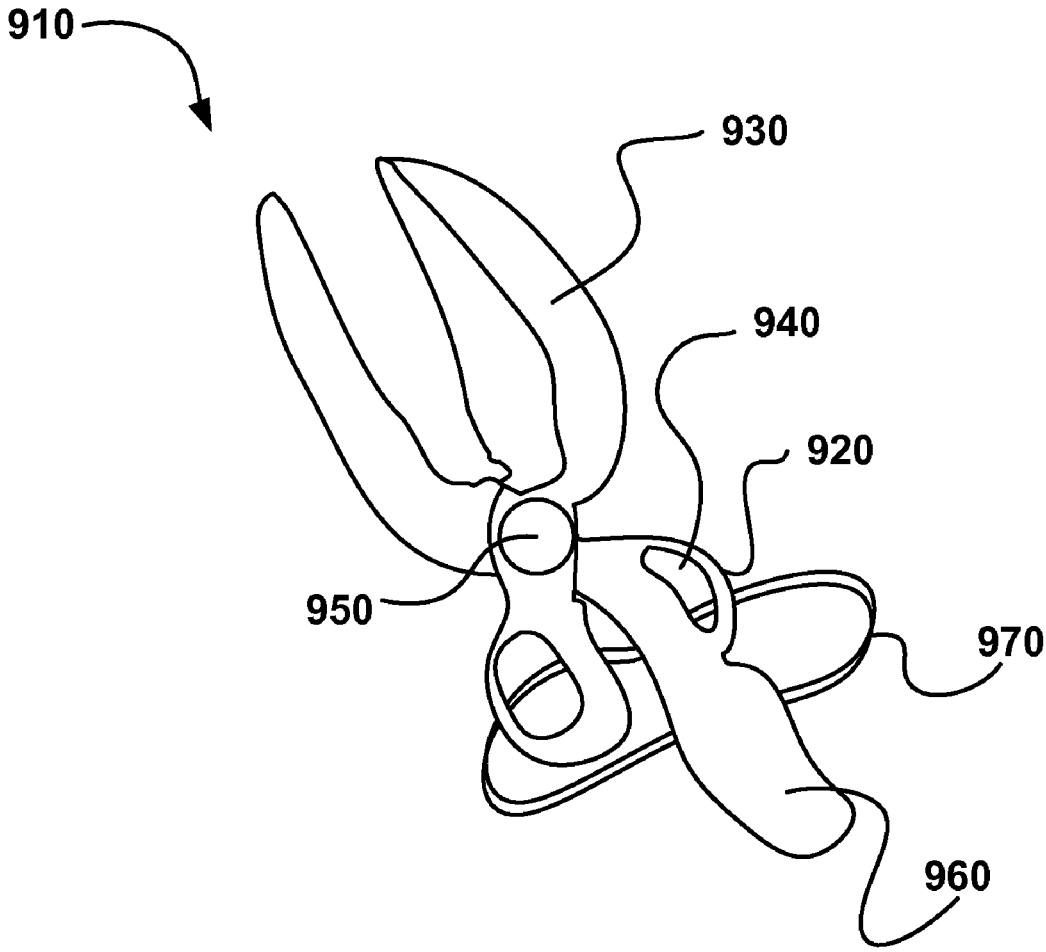
FIG. 9 illustrates another example of a device for collecting animal feces.

Another example of a device is illustrated in FIG. 6, which is a perspective view of a device 610 having a scoop portion 630 including scooping surface 640 and a more compact handle 620. This device may be easier to store but places the operator much closer to the waste products. FIG. 7 illustrates a perspective view of yet another device 710 including a handle 720 and two scoop portions 730 affixed to the handle 720. The scoop portion may be opened and closed so as to be positioned over the waste and close around the waste to contain the waste between the scoop portions 730 and in contact with the scooping surfaces 740. FIG. 8 also illustrates an example of a device 810 include a handle 820 and a scoop portion 830. The scoop portion includes scooping surface 840, an opening 850, defined in one of the scooping surfaces, over which a bag 860 may be positioned wherein waste may be received into the bag. While the bag may aid in retaining the waste, the waste may still contact the scoop portion. FIG. 9 illustrates a further example of a device contemplated herein, wherein the device 910 may include handles 920 and scoop portions 930, which may in some embodiments, be unitary or integrated into the each handle. In addition, each handle 920 may include a finger loop 940. The scoops and handles may be pivotably affixed together around a pivot point 950 such that moving the finger loops together moves the scoop portions together. In addition, a larger handle 960 may be provided for the user to grasp and a wrist loop 970 may be provided for carrying the device.

Figure 10:
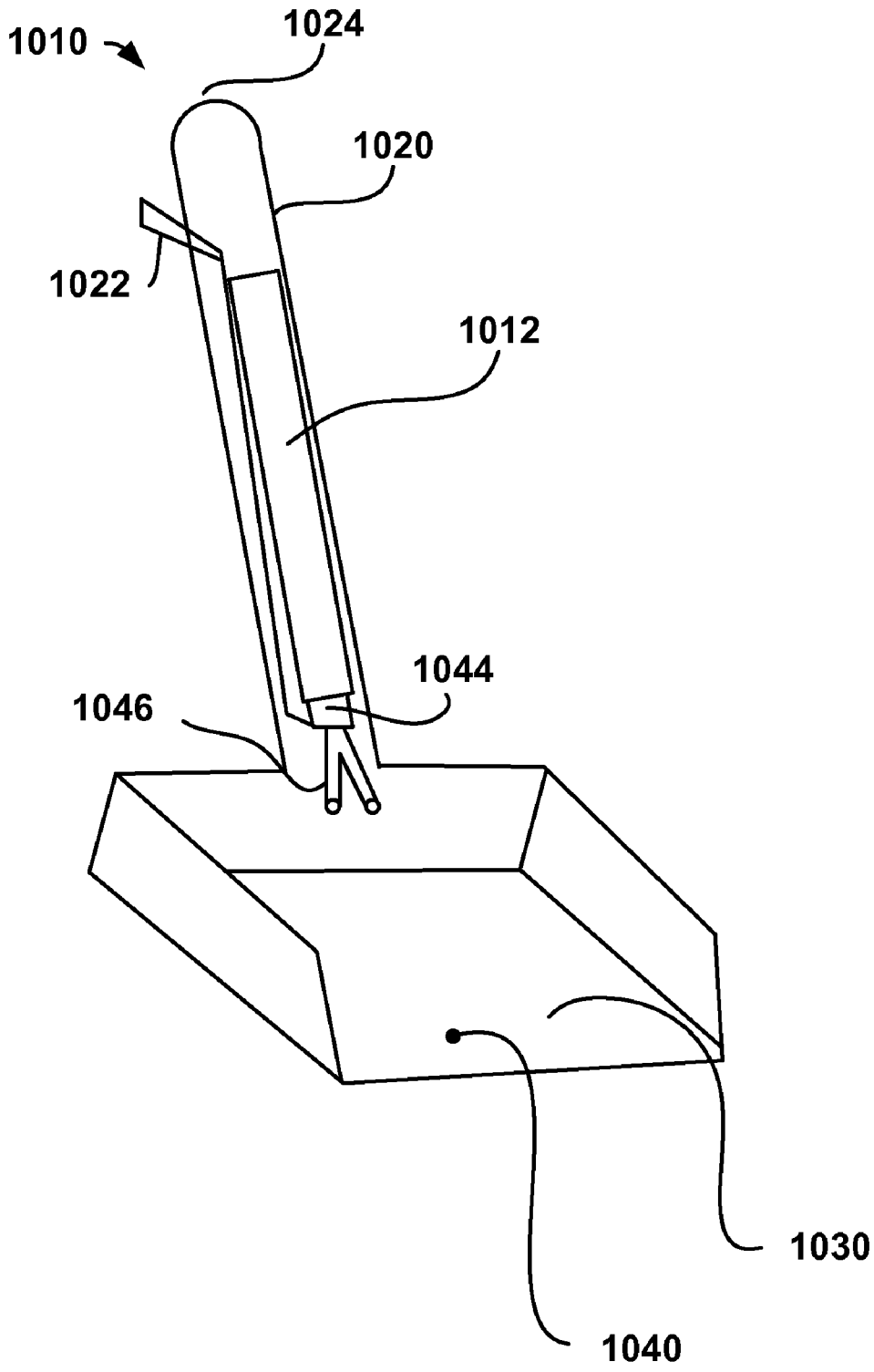
FIG. 10 illustrates another example of a device for collecting animal feces, wherein a cross-sectional view of the device is shown to illustrate the interior portion of the handle.

The device may also include a pressurized spray device for rinsing the coated surface, as illustrated in FIG. 10. The device 1010 may include a handle 1020 and a scoop 1030. In addition, a container 1012 for the rinsing fluid may be provided inside a handle 1020. A trigger 1022 for actuating the spray may be positioned in a proximal end of the handle 1020, i.e., the end of the handle near the user. In one example, the trigger may actuate a pump 1044, which may force the rinsing agent through one or more openings 1046, which may be provided proximate to the surface 1040, configured to direct the rinsing fluid towards the surface 1040. The rinsing agent may then aid in the removal of waste from the surface.

The description and drawings illustratively set forth the presently preferred invention embodiments. The description and drawings are intended to describe these embodiments and not to limit the scope of the invention. Those skilled in the art will appreciate that still other modifications and variations of the present invention are possible in light of the above teaching while remaining within the scope of the following claims. Therefore, within the scope of the claims, one may practice the invention otherwise than as the description and drawings specifically show and describe.

What is claimed is:

1. A device for retrieving animal feces, comprising:
- a handle portion;
- a scoop portion having a working surface, wherein at least said working surface of the scoop portion contacts the feces for removal;
- a spray device coupled to at least said handle portion and configured to aid in removal of the animal feces from said working surface of said scoop portion, said spray device comprising:
  - a reservoir;
  - a pump in fluid communication with said reservoir;
  - at least one outlet in fluid communication with said reservoir and said pump, said at least one outlet positioned proximate to at least said workin surface of said scoop portion; and
  - a trigger configured to actuate said pump, thereby forcing a rinsing solution through said at least one outlet, said at least one outlet being configured to direct said rinsing solution towards said working surface of said scoop portion;
- wherein said handle defines an axis, and said working surface of said scoop portion is positioned at an angle β between 30 degrees to 80 degrees from said handle axis, and wherein feces material is retained by at least said working surface of the scoop portion when the scoop portion is lifted from the ground; and
- wherein at least a portion of said working surface of said scoop portion includes a coating, wherein said coating exhibits a coefficient of friction (μ) of less than or equal to 1.0 and a contact angle of 90° or greater relative to animal waste.

2. The device of claim 1, wherein said coating includes a fluoropolymer.

3. The device of claim 1, wherein said coating includes nickel.

4. The device of claim 1, wherein said coating includes molybdenum.

5. The device of claim 1, wherein said coating includes a silicone.

6. The device of claim 1 wherein said scoop portion comprises a relatively rigid plastic comprising one or more of polystyrene and/or acrylonitrile-butadiene-styrene.

7. A method of providing a pooper scooper having a surface that is relatively easy to clean, comprising:
- providing a device for retrieving animal feces, comprising;
  - a handle portion;
  - a scoop portion having a working surface, wherein at least said working surface of the scoop portion contacts the feces for removal;
  - a spray device coupled to at least said handle portion and configured to aid in removal of the animal feces from said working surface of said scoop portion, said spray device comprising:
    - a reservoir;
    - a pump in fluid communication with said reservoir;
    - at least one outlet in fluid communication with said reservoir and said pump, said at least one outlet positioned proximate to at least said working surface of said scoop portion; and
    - a trigger configured to actuate said pump, thereby forcing a rinsing solution through said at least one outlet, said at least one outlet being configured to direct said rinsing solution towards said working surface of said scoop portion;
  - wherein said handle defines an axis and said working surface of said scoop portion is positioned at an angle β between 30 degrees to 80 degrees from said handle axis wherein feces material is retained by at least said working surface of the scoop portion when the scoop portion is lifted from the ground; and
- coating at least a portion of said working surface of said scoop portion with a coating, wherein said coating exhibits a coefficient of friction (μ) of less than or equal to 1.0 and a contact angle of 90° or greater relative to animal waste.

8. The method of claim 7, wherein said coating includes a fluoropolymer.

9. The method of claim 7, wherein said coating includes nickel.

10. The method of claim 7, wherein said coating includes molybdenum.

11. The method of claim 7, wherein said coating includes a silicone.

12. The method of claim 7, wherein said coating comprises over molding.

13. The method of claim 7, wherein said coating comprises thermal spray coating.

14. The method of claim 7, wherein said coating comprises physical vapor deposition.

15. The method of claim 7 wherein said scoop portion comprises one or more of polystyrene and/or acrylonitrile-butadiene-styrene.

16. A method of retrieving animal solid waste from a surface, comprising:
- providing a device for retrieving animal solid waste, comprising:
  - a handle portion;
  - a scoop portion having a working surface, wherein at least said working surface of the scoop portion contacts the animal solid waste for removal;
  - a spray device coupled to at least said handle portion and configured to aid in removal of the animal solid waste from said working surface of said scoop portion, said spray device comprising:

a reservoir;

a pump in fluid communication with said reservoir;

at least one outlet in fluid communication with said reservoir and said pump, said at least one outlet positioned proximate to at least said working surface of said scoop portion; and a trigger configured to actuate said pump, thereby forcing a rinsing solution through said at least one outlet, said at least one outlet being configured to direct said rinsing solution towards said working surface of said scoop portion;

wherein said handle defines an axis and said working surface of said scoop portion is positioned at an angle β between 30 degrees to 80 degrees from said handle axis wherein animal solid waste is retained in at least said working surface of the scoop portion when the scoop portion is lifted from the ground; and slipping at least the working surface of the scoop portion under said animal solid waste, and tipping the handle to a vertical position to control and contain said animal solid waste by at least said working surface of said scoop portion;

wherein at least a portion of said working surface of said scoop portion includes a coating, wherein said coating exhibits a coefficient of friction (μ) of less than or equal to 1.0 and a contact angle of 90° or greater relative to animal waste.

17. The method of claim 16, further comprising rinsing said working surface of said scoop portion via said spray device with water or disinfectant solution.

18. The method of claim 16 wherein said scoop portion comprises one or more of polystyrene and/or acrylonitrile-butadiene-styrene.

* * * * *